United States Patent [19]

Hayashi

[11] Patent Number: 5,065,683

[45] Date of Patent: Nov. 19, 1991

[54] THREAD TRIMMER MECHANISM FOR SEWING MACHINES

[75] Inventor: Kazutoshi Hayashi, Nagoya, Japan

[73] Assignee: Brother Kogyo Kabushiki Kaisha, Japan

[21] Appl. No.: 624,086

[22] Filed: Dec. 7, 1990

[30] Foreign Application Priority Data

Jan. 12, 1990 [JP] Japan ..... 2-5532

[51] Int. Cl.[5] ..... D05B 65/02

[52] U.S. Cl. ..... 112/292; 112/229

[58] Field of Search ..... 112/292, 291, 296, 297, 112/298, 300, 231, 229, 184, 181, 182, 285, 289

[56] References Cited

U.S. PATENT DOCUMENTS 2,555,658 6/1951 Ritter ..... 112/229
4,363,282 12/1982 Satake ..... 112/231 X
4,586,449 5/1986 Raupach ..... 112/297 X

FOREIGN PATENT DOCUMENTS 52-426 1/1977 Japan .
57-41958 9/1982 Japan .
63-37024 9/1988 Japan .

*Primary Examiner*—Peter Nerbun
*Attorney, Agent, or Firm*—Oliff & Berridge

[57] ABSTRACT

In a thread trimmer mechanism on a sewing machine, a movable knife for catching and cutting thread and a bobbin pressing member for pressing and applying frictional resistance to a bobbin are operated synchronously with a rotary hook assembly. After needle thread caught by a hook of the rotary hook assembly has passed the end surface of the bobbin, the bobbin pressing member presses the end surface of the bobbin. Therefore, the needle thread is prevented from being caught in the bobbin pressing member and from being excessively supplied. Almost at the same time as the bobbin pressing member presses the end surface of the bobbin, the movable knife catches and cuts the thread. Consequently, even when the movable knife pulls bobbin thread from the bobbin, the bobbin is prevented from spinning freely. As a result, only a short thread extends from the last stitch on cloth, thus enhancing the appearance of the cloth and possibly eliminating a separate trimming operation.

14 Claims, 5 Drawing Sheets

THREAD TRIMMER MECHANISM FOR SEWING MACHINES

BACKGROUND OF THE INVENTION

This invention relates to a thread trimmer mechanism provided under a sewing-machine table of a sewing machine for cutting thread leading to the cloth after a sewing operation, and especially to a thread trimmer mechanism that controls the length of the thread being cut.

Thread trimmer mechanisms are known in the art and, for example, one is disclosed in Japan Published Examined Patent Application No. 57-41958. In the mechanism, a looper is operated to form single-thread chainstitches. When the needle thread is cut, the looper holds the needle thread so that the needle thread will not be cut too short. The needle thread is thus prevented from coming out of the eye of the needle which would, of course, require re-threading of the needle.

A thread trimmer mechanism is also disclosed in Japan Published Examined Utility Model Application No. 63-37024. In this related-art reference, a thread supply device is provided for supplying a pre-determined amount of needle thread from a spool. In relation with the operation of the thread trimmer, the thread supply device supplies the predetermined amount of needle thread from the spool prior to the trimming operation.

Both these related-art references control the length of the needle thread when the needle thread is cut, thus preventing the needle thread from coming out of the eye of the needle. Neither of the references controls the length of bobbin thread supplied from a bobbin in a rotary hook assembly, however. Therefore, when the bobbin thread is cut in sewing machines employing these prior art techniques, the bobbin thread is excessively drawn from the freely-spinning bobbin as a result of the operation of the thread trimmer.

To prevent the bobbin in the rotary hook assembly from spinning, a bobbin presser lever is disclosed in Japan Published Examined Patent Application No. 52-426. When the bobbin thread is cut, the bobbin presser lever slides and contacts the bobbin, thus preventing the bobbin from rotating further. As a negative feature, however, when the bobbin presser lever presses the bobbin during the cutting of the bobbin thread, the needle thread caught by the hook of the rotary hook assembly engages with the bobbin presser lever before the needle thread forms a loop around a bobbin holder in the rotary hook assembly. Subsequently, the needle thread is pulled toward a thread trimming knife. Consequently, an excessive amount of the needle thread is supplied. The time required to supply the excessive amount of needle thread increases the time in a cycle of the automatic thread trimming operation. A large load is applied to the needle thread supply device. As a result, a long thread extends from the last stitch on the cloth, thereby impairing the appearance of the cloth and requiring an additional trimming operation.

SUMMARY OF THE INVENTION

Wherefore, an object of this invention is to provide a thread trimmer mechanism for a sewing machine that prevents a bobbin in a rotary hook assembly of the sewing machine from spinning when bobbin thread is cut to control the length of the bobbin thread and also control a supply amount of needle thread.

Other objects and benefits of the invention will become apparent from the detailed description which follows hereinafter when taken in conjunction with the drawing figures which accompany it.

To solve this and other objects, this invention provides a new thread trimmer mechanism. The thread trimmer mechanism comprises a movable knife for catching thread between the cloth and a rotary hook assembly and for cutting the thread in cooperation with a fixed knife at a position apart from a position where the movable knife catches the thread, and a bobbin pressing member movable between an operational position and a retracted position for contacting and applying frictional resistance to a bobbin in the rotary hook assembly when the bobbin pressing member is moved to the operational position. The thread trimmer mechanism also comprises a movable knife drive means for driving the movable knife such that when a hook of the rotary hook assembly catches the needle thread and the rotary hook assembly rotates a predetermined angle, the movable knife catches the thread and cuts the thread in cooperation with the fixed knife. The thread trimmer mechanism further comprises a bobbin pressing member drive means for driving the bobbin pressing member such that when the hook of the rotary hook assembly catches the needle thread and the rotary hook assembly rotates the pre-determined angle, the bobbin pressing member presses a portion of an end surface of the bobbin of the rotary hook assembly, i.e., the portion where the needle thread has passed.

Figure 1:
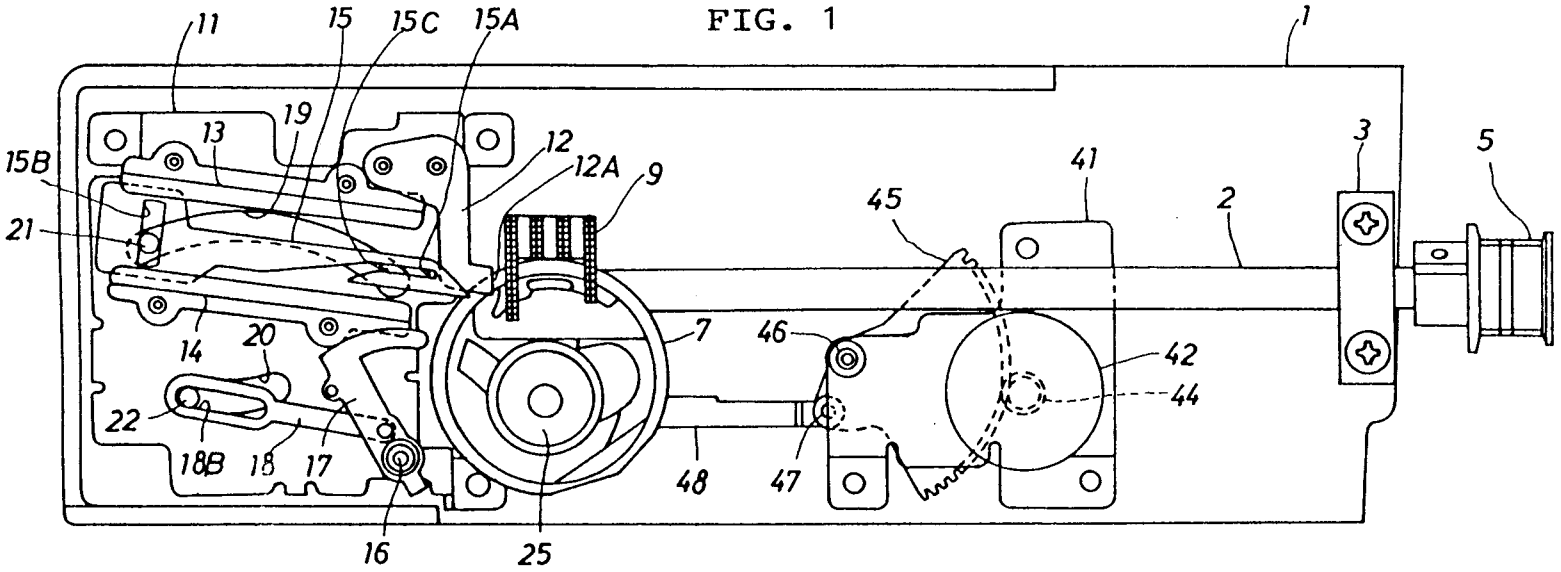
FIG. 1 is a plan view of a thread trimmer mechanism in a sewing machine embodying the present invention.
Figure 2:
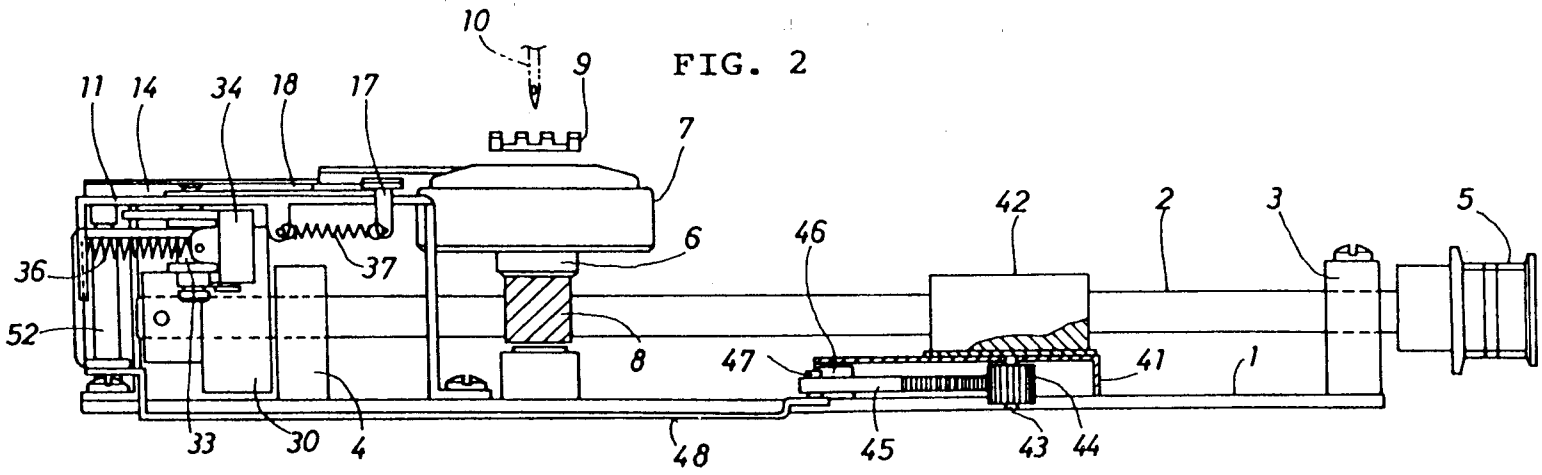
FIG. 2 is a side view of the thread trimmer mechanism of FIG. 1.

DETAILED DESCRIPTION OF THE PREFERRED EMBODIMENT:

As shown in FIGS. 1 and 2, the thread trimmer mechanism of the invention is provided under a sewing-machine table and cuts thread held by a rotary hook assembly 7. A lower shaft 2 is rotatably supported by two bearings 3 and 4 on a lower frame 1 of the thread trimmer mechanism. A toothed pulley 5 is attached to the right end of the lower shaft 2 in FIGS. 1 and 2, and is rotated by a timing belt (not shown) synchronously with a main shaft of a sewing machine. A vertical shaft 6 is set up almost on the middle of the lower frame 1 such that the vertical shaft 6 can rotate around a perpendicular rotational axis. The rotary hook assembly 7 is attached to the upper end of the vertical shaft 6 such that the rotary hook assembly 7 and the vertical shaft 6 can rotate together. A hypoid gear 8 is provided in the middle of the vertical shaft 6 and meshes with a hypoid gear (not shown) on the lower shaft 2. The gearing is such that while the lower shaft 2 rotates once, the rotary hook assembly 7 rotates twice. As shown in FIG. 1, a bobbin 25 with bobbin thread wound around it is held in the rotary hook assembly 7. A feed dog 9 is provided above the rotary hook assembly 7, and a needle 10 lowers toward the feed dog 9. The supporting mechanism for the feed dog 9 is omitted from FIGS. 1 and 2 in the interest of simplicity.

As further shown in FIGS. 1 and 2, an upper frame 11 is secured onto the lower frame 1 at the left of the rotary hook assembly 7 as the figure is viewed. The upper frame 11, formed of a pressed plate, is provided almost as high as the top surface of the rotary hook assembly 7.

On the upper right corner of the upper frame 11, a fixed knife 12 having a blade 12A on its end is secured. A movable knife 15 is supported by opposite guides 13 and 14 such that the movable knife 15 can move linearly. A bobbin presser lever 17 is rotatably supported by a pivot 16 on the upper frame 11, and a connecting lever 18 is connected to the bobbin presser lever 17.

Figure 3:
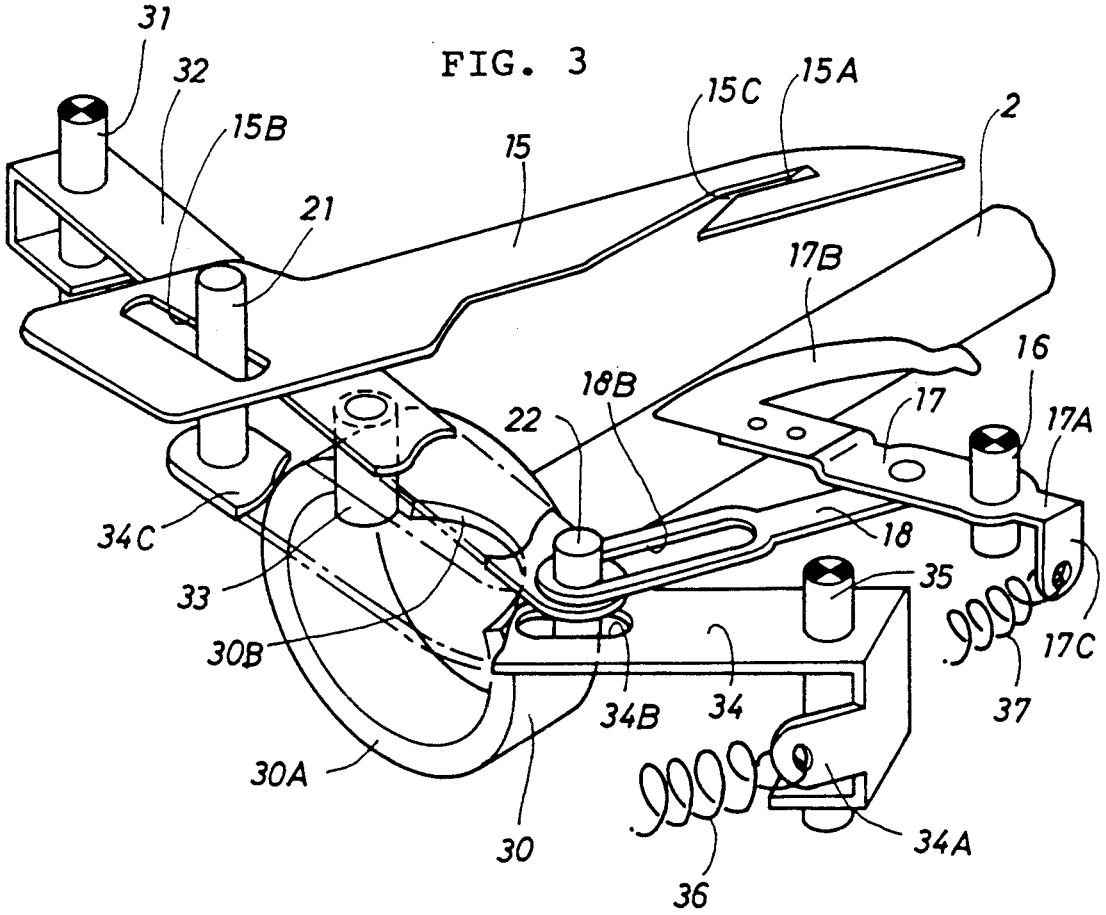
FIG. 3 is a perspective view of a drive mechanism for the thread trimmer mechanism.

As shown in FIG. 3, the movable knife 15 is shaped like a key having a pointed end. A slot 15C extends toward the pointed end of the movable knife 15, and a blade 15A is formed at the end of the slot 15C. The knife 15 is thus hook-shaped so as to be able to grab a thread and pull it into the slot 15C to be cut by the blade 15A at the inner end thereof.

As best seen in FIG. 1, two arc-shaped slots 19 and 20 are provided in the upper frame 11. A pin 21 passing through the slot 19 engages a slot 15B of the movable knife 15 and thereby drives the movable knife 15. A pin 22 passing through the slot 20 engages a slot 18B of the connecting lever 18 and thereby drives the connecting lever 18.

A drive mechanism for driving the movable knife 15 and the bobbin presser lever 17 synchronously with the rotation of the rotary hook assembly 7 will now be explained, referring to FIG. 3 with particularity. Again in the interest of simplicity, the support mechanism for the upper frame 11 and associated components is not shown in FIG. 3. As can be seen from the figure, a thread trimmer clutch 30 is secured to the lower shaft 2. The thread trimmer clutch 30 is a cylindrical cam of resin and has a rim composing a cam surface 30A. An indentation 30B forms a part of the cam surface 30A of the thread trimmer clutch 30. A pivot 31 is secured onto the upper frame 11. A first thread trimming lever 32 is horizontally rotatably supported by the pivot 31 close to the underside of the upper frame 11. A roller 33 extends downward from and is rotatably supported at the center of the first thread trimming lever 32. The roller 33 follows the movement of the thread trimmer clutch 30 by contacting the cam surface 30A of the thread trimmer clutch 30. As shown in FIG. 3, the pin 22 is fixed through the end of the first thread trimming lever 32. The pin 22 extends upward through the slot 20 in the upper frame 11 and engages the slot 18B of the connecting lever 18. The pin 22 also extends downward and engages a slot 34B in a second thread trimming lever 34.

As best seen in FIG. 3, the second thread trimming lever 34 is formed into an almost L-shape by bending a plate material to shape and is supported by a pivot 35 on the upper frame 11 such that the second thread trimming lever 34 can rotate about the pivot 35. An extension spring 36 between a hook 34A of the second thread trimming lever 34 and the upper frame 11 applies a bias force for rotating the second thread trimming lever 34 clockwise. The pin 21 is secured on an end 34C of the second thread trimming lever 34, extends upward through the slot 19, and engages the slot 15B of the movable knife 15.

The bobbin presser lever 17 is horizontally rotatable about the pivot 16 on the upper frame 11 and is shaped like a small scythe. The bobbin presser lever 17 includes a support portion 17A formed by pressing a plate material. A bobbin pressing portion 17B is formed of a leaf spring material and is attached to the support portion 17A as by rivets. The end of the bobbin pressing portion 17B is bent so that it can press the bobbin 25 when the bobbin presser lever 17 is rotated and the bobbin pressing portion 17B is moved t the top of the rotary hook assembly 7. An extension spring 37 is placed between a hook 17C of the bobbin presser lever 17 and the upper frame 11. The extension spring 37 thus applies a bias force to the bobbin presser lever 17 so that the bobbin presser lever 17 can rotate clockwise and the bobbin pressing portion 17B is moved to the top of the rotary hook assembly 7.

The connecting lever 18 is supported by the bobbin presser lever 17 such that the connecting lever 18 can rotate horizontally. The pin 22, fixed through the end of the first thread trimming lever 32, engages the slot 18B in the connecting lever 18. The bobbin presser lever 17 is thus rotated through the connecting lever 18, following the rotation of the first thread trimming lever 32.

The tensile force of the extension springs 36 and 37 is applied through the pin 22 to the first thread trimming lever 32. The first thread trimming lever 32 is thus rotated counterclockwise, thereby pressing the roller 33 onto the cam surface 30A of the thread trimmer clutch 30. When the first thread trimming lever 32 rotates along the outline of the thread trimmer clutch 30, the second thread trimming lever 34 rotates and the movable knife 15 moves linearly. The rotation of the first thread trimming lever 32 is transmitted through the connecting lever 18 to the bobbin presser lever 17, thereby rotating the bobbin presser lever 17.

The bobbin presser lever 17 can be moved between its operational position above the rotary hook assembly 7 and its retracted position on the upper frame 11. When the bobbin presser lever 17 is moved into the operational position, the bobbin presser lever 17 slides and contacts the bobbin 25 in the rotary hook assembly 7, thus applying frictional resistance to the bobbin 25. The thread trimmer clutch 30, the roller 33, the first and second thread trimming levers 32 and 34, and the pin 21 compose a drive mechanism for the movable knife 15. After a hook 7A of the rotary hook assembly 7 catches the needle thread and the rotary hook assembly 7 rotates by a pre-determined angle, the hook-shaped movable knife 15 catches and cuts the sewing thread in cooperation with the fixed knife 12. On the other hand, the thread trimmer clutch 30, the roller 33, the first and second thread trimming levers 32 and 34, and the connecting lever 18 compose a drive mechanism for driving the bobbin presser lever 17. After the hook 7A of the rotary hook assembly 7 catches the needle thread and the rotary hook assembly 7 rotates a pre-determined angle, the bobbin presser lever 17 contacts the end surface of the bobbin 25 in the rotary hook assembly 7 and presses the needle thread passing the end surface of the bobbin 25.

A mechanism for inhibiting the movable knife 15 from cutting thread during sewing operations will now be explained. As shown in FIGS. 1 and 2, a step motor 42 is secured onto a support base 41 provided on the right of the lower frame 1 as the figure is viewed. An output shaft 43 extends downward from the underside of the step motor 42. A pinion 44 is provided around the output shaft 43 and meshes with a sector gear 45. The sector gear 45 is rotatably supported by a pivot 46 on the support base 41 and is connected by a pin 47 to a drive board 48.

Figure 6:
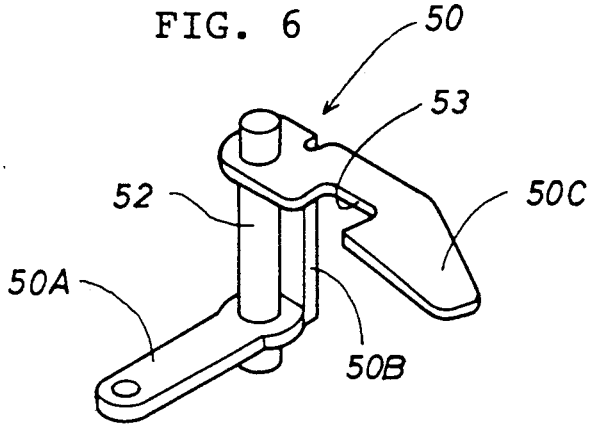
FIG. 6 is a perspective view of a lock lever in the locking mechanism.
Figure 4:
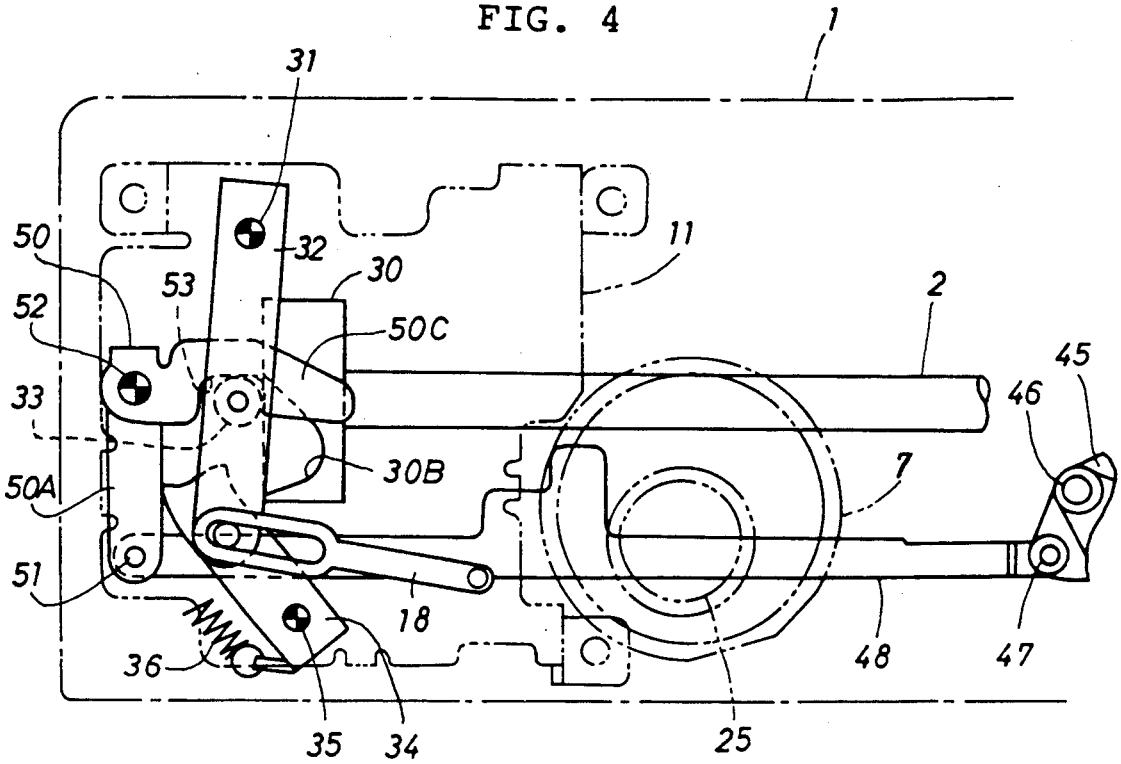
FIG. 4 is a plan view showing a locking mechanism for the thread trimmer mechanism.
Figure 5:
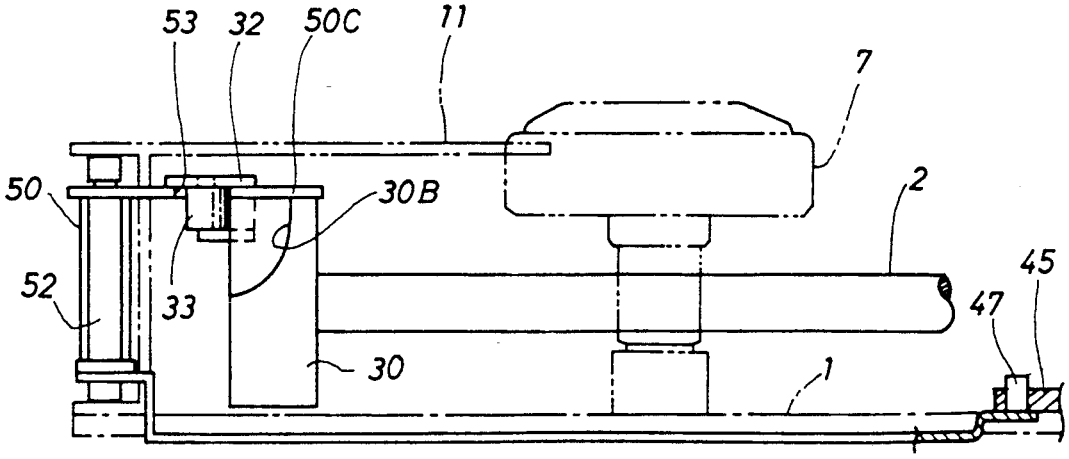
FIG. 5 is a side view of the locking mechanism in FIG. 4.

As shown in FIG. 4, the drive board 48 extends to the left under the lower frame 1 and is connected by a pin 51 to a lock lever 50 at the left end of the lower frame 1. As shown in FIG. 6, the lock lever 50 is formed by bending a plate material and comprises an arm 50A, a strut 50B, and a lock member 50C. The arm 50A extends horizontally to the lower end of the strut 50B. The strut 50B extends upright, and the lock member 50C extends horizontally from the upper end of the strut 50B, forming a right angle with the arm 50A. The lock member 50C has a notch 53 for engaging the roller 33. A pivot 52 passes through holes in the lock member 50C and the arm 50A adjacent to the strut 50B. As shown in FIG. 5, the lock lever 50 is supported by the pivot 52 on the upper and lower frames 11 and 1 such that the lock lever 50 can rotate horizontally.

The rotational position of the sector gear 45 is controlled by the step motor 42 and defines the rotational position of the lock lever 50. When the lock lever 50 is in the rotational position as shown in FIG. 4, the notch 53 in the lock lever 50 receives the roller 33, thereby locking the lock lever 50. When the lock lever 50 is thus locked in the rotational position as shown in FIG. 4, the roller 33 cannot follow the movement of the thread trimmer clutch 30. The first thread trimming lever 32 is also locked in the rotational position where the movable knife 15 and the bobbin presser lever 17 are retracted. When the lock lever 50 is rotated counterclockwise about the pivot 52, the notch 53 disengages from the roller 33. The roller 33 can then contact the cam surface 30A of the thread trimmer clutch 30, thus following the movement of the thread trimmer clutch 30.

In operation, when a sewing operation ends, or when an operator starts a thread trimming operation, the step motor 42 is driven first and the lock lever 50 is unlocked and rotated counterclockwise. As a result, the tensile force of the extension springs 36 and 37 presses the roller 33 onto the cam surface 30A of the thread trimmer clutch 30. Subsequently, the lower shaft 2 is rotated once by a sewing-machine motor (not shown) and the needle 10 reciprocates vertically once.

Figure 7A:
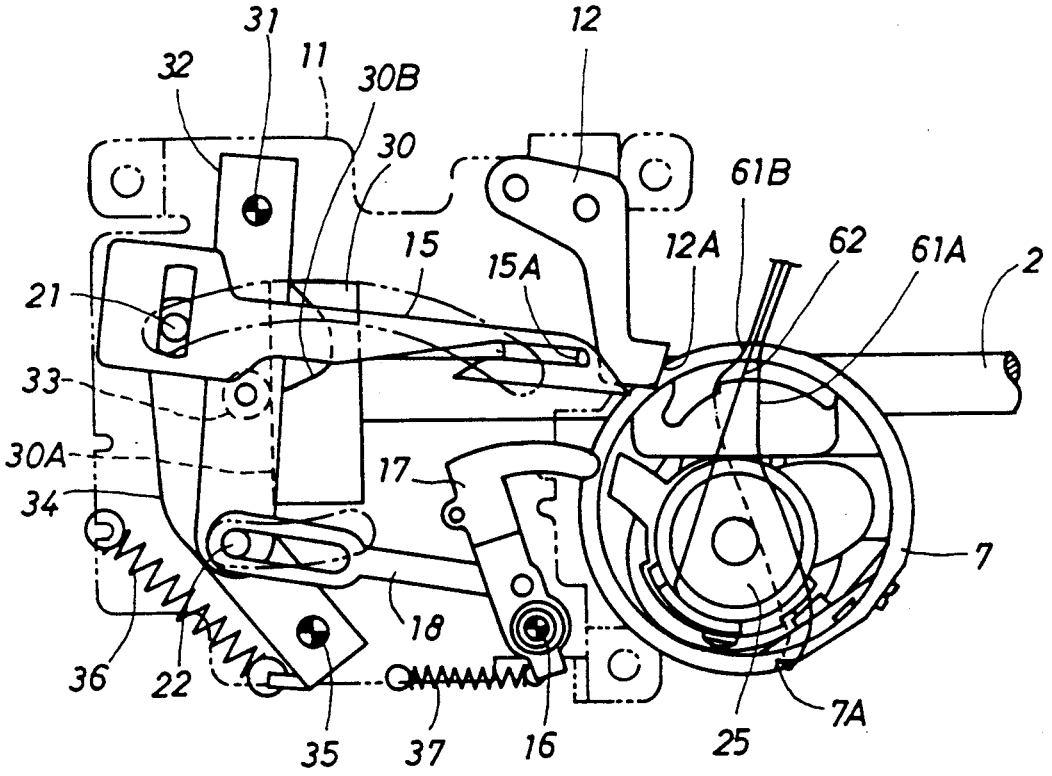
FIGS. 7A, 7B, and 7C are plan views illustrating the operation of the thread trimmer mechanism.

Operation of the thread trimmer mechanism for the embodiment will now be explained, referring with particularity to FIGS. 7A, 7B and 7C. When the needle 10 starts rising from the lowest point of its stroke, the hook 7A of the rotary hook assembly 7 catches a loop of needle thread 61A, 61B formed by the rising of the needle 10 and the half rotation of the rotary hook assembly 7. During such operation, as shown in FIG. 7A, the roller 33 rotates along the cam surface 30A of the thread trimmer clutch 30. The first thread trimming lever 32 is kept adjacent to its locked rotational position and the movable knife 15 and the bobbin presser lever 17 remain retracted.

Figure 7B:
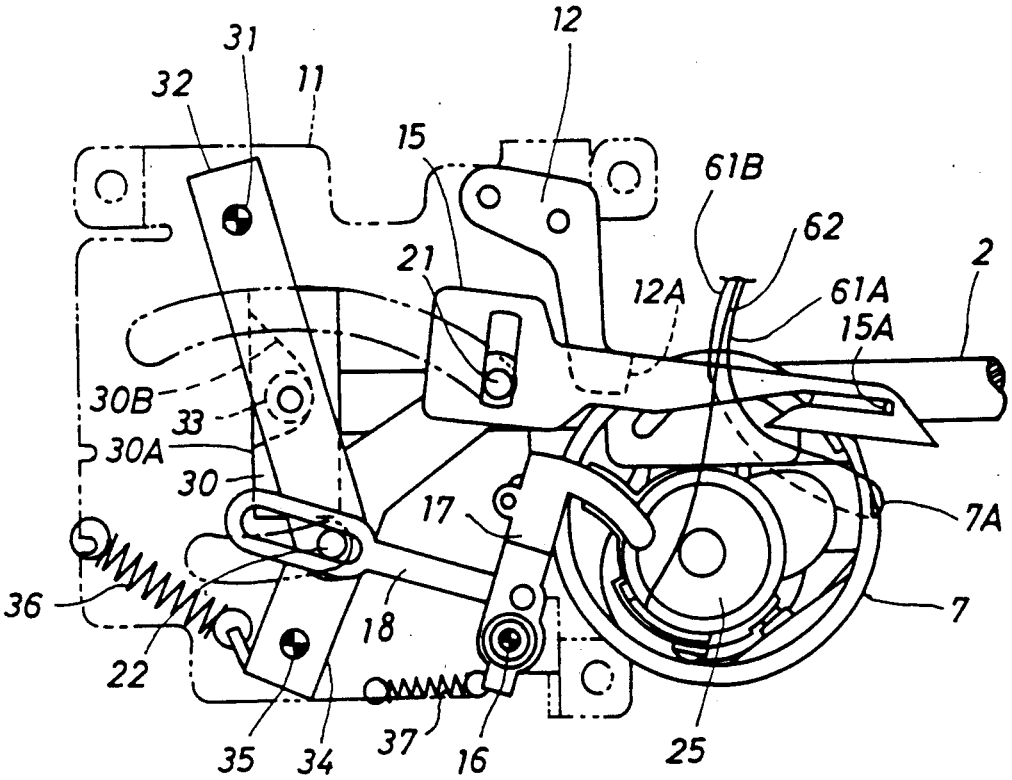

Subsequently, as shown in FIG. 7B, the thread trimmer clutch 30 further rotates and the roller 33 engages the indentation 30B. The first thread trimming lever 32 is rotated counterclockwise about the pivot 31. The rotation of the first trimming lever 32 is transmitted through the pin 22 in the slot 34B to the second thread trimming lever 34. The second thread trimming lever 34 is rotated clockwise about the pivot 35. The movable knife 15, connected through the pin 21 in the slot 15B to the second thread trimming lever 34, advances to the top of the rotary hook assembly 7. At the same time, the extension spring 37 acts on the bobbin presser lever 17 connected by the connecting lever 18 to the first thread trimming lever 32, and the bobbin presser lever 17 is rotated clockwise about the pivot 16.

When the movable knife 15 advances, the tip of the movable knife 15 passes near the top surface of the rotary hook assembly 7, below the needle thread 61A leading to cloth, and below a bobbin thread 62 extending from the bobbin 25 to the cloth. The needle thread 61B extending from the needle 10 is below the movable knife 15 because the needle thread 61B passes below a bobbin case holder. On the other hand, when the bobbin presser lever 17 is rotated clockwise, the bobbin presser lever 17 contacts and presses the end surface of the bobbin 25 in the rotary hook assembly 7, by using the resilience of the bobbin pressing portion 17B which, as described above, is formed of leaf spring material.

The position of the thread trimmer clutch 30 on the lower shaft 2 is pre-determined such that when the roller 33 starts engaging the indentation 30B of the thread trimmer clutch 30, the rotary hook assembly 7 rotates 180 degrees or further after the hook 7A of the rotary hook assembly 7 catches the needle thread 61A, 61B, and the needle thread 61A leading to the cloth passes the half or more of the end surface of the bobbin 25. When the bobbin presser lever 17 contacts the end surface of the bobbin 25, the needle thread 61A leading to the cloth has passed the end surface of the bobbin 25. Consequently, the needle thread 61A is prevented from being entangled in the bobbin presser lever 17.

Figure 7C:
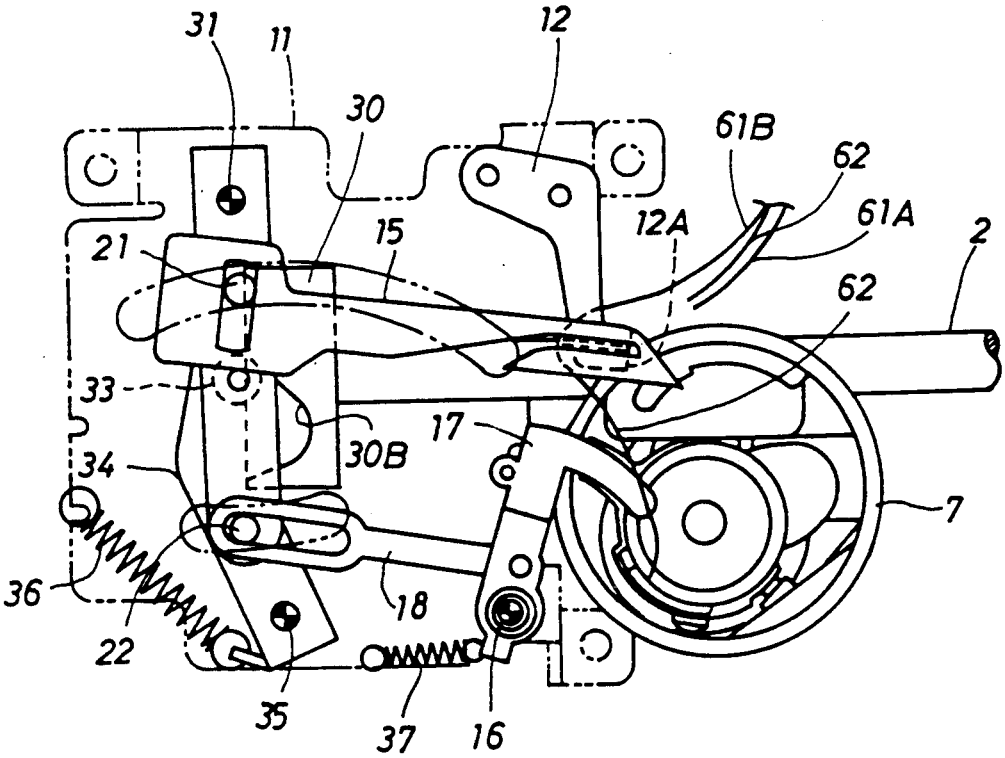

Subsequently, as shown in FIG. 7C, the roller 33 starts leaving the indentation 30B of the thread trimmer clutch 30, and the first thread trimming lever 32 starts rotating clockwise. The second thread trimming lever 34 is rotated counterclockwise, and the movable knife 15 is retracted. The needle thread 61A leading to the cloth and the bobbin thread 62 from the bobbin 25 are hooked and caught in the slot 15C, and pulled toward the fixed knife 12. The blade 12A of the fixed knife 12 and the blade 15A of the movable knife 15 cooperate and cut the needle thread 61A, 61B and the bobbin thread 62. On the other hand, even when the first thread trimming lever 32 starts rotating clockwise, the bobbin presser lever 17 is not immediately retracted, because the pin 22 fixed in the first thread trimming lever 32 backlashes in the slot 18B of the connecting lever 18. The bobbin presser lever 17 remains on the end surface of the bobbin 25 until the blade 15A of the movable knife 15 passes the blade 12A of the fixed knife 12.

When the movable knife 15 catches and pulls the needle thread 61A, 61B and the bobbin thread 62, the bobbin pressing portion 17B of the bobbin presser lever 17 slidably contacts the end surface of the bobbin 25. The bobbin presser lever 17 thus applies frictional resistance to the end surface of the bobbin 25. Consequently, even if the movable knife 15 pulls the bobbin thread 62 strongly from the bobbin 25, the bobbin 25 is prevented from freely spinning and an excess amount of the bobbin thread 62 is prevented from being drawn from the bobbin 25. After the needle thread 61A leading to the cloth has passed the end surface of the bobbin 25, the bobbin presser lever 17 presses the end surface of the bobbin 25. The needle thread 61A is thus prevented from being caught in the bobbin presser lever 17. When the needle thread 61A, 61B and the bobbin thread 62 are cut, the loop of the needle thread 61A, 61B becomes smaller and surrounds the blade 15A of the movable knife 15. Therefore, the length of the needle thread 61A, 61B shortens, and the amount of the needle thread 61A, 61B supplied through the needle 10 decreases. However, since the needle thread 61A, 61B is pulled to the blade 12A of the fixed knife 12, the needle thread 61A, 61B is long enough to be prevented from coming out of the needle 10.

When the roller 33 leaves the indentation 30B of the thread trimmer clutch 30, the pin 22 of the first thread trimming lever 32 engages in the left end of the slot 18B. The connecting lever 18 is thus pulled, and the bobbin presser lever 17 is rotated counterclockwise. The bobbin presser lever 17 is retracted from the rotary hook assembly 7 back to the upper frame 11. The roller 33 rotates along the cam surface 30A of the thread trimmer clutch 30. The movable knife 15 and the bobbin presser lever 17 are retracted.

This invention has been described above with reference to a preferred embodiment as shown in the drawings. Modifications and alterations may become apparent to one skilled in the art upon reading and understanding the specification. Despite the use of a single embodiment for illustration purposes, however, it is intended to include all such modifications and alterations within the scope and spirit of the appended claims.

In this spirit, it should also be noted that in the embodiment as shown and described, the thread trimmer clutch 30, the roller 33, the first and second thread trimming levers 32 and 34, and the associated components compose a cam mechanism for driving the movable knife 15 and the bobbin presser lever 17. However, an air cylinder, an electromagnetic solenoid, or the like, could be employed to replace the cam mechanism if desired. Also, the rotational position of the rotary hook assembly 7 could be detected by a photo sensor and controlled using electric signals.

Wherefore, having thus described the present invention, what is claimed is:

1. A thread trimmer mechanism for a sewing machine that prevents a bobbin in a rotary hook assembly o-f the sewing machine from spinning when bobbin thread is cut, the thread trimmer mechanism comprising:

a) fixed knife means for cutting thread located at a first position of the sewing machine adjacent the rotary hook assembly;

b) movable knife means movable between a second position retracted from said first position and a third position located between a point of connection of the thread to cloth being sewn and the rotary hook assembly, said movable knife means catching thread at said third position removed from said first and second positions and cutting said thread in cooperation with said fixed knife at said first position;

c) bobbin stopping means movable between an operational position and a retracted position for contacting the bobbin and preventing the bobbin from spinning in the rotary hook assembly when said bobbin stopping means is moved to said operational position;

d) movable knife drive means for driving said movable knife means such that when a hook of the rotary hook assembly catches the needle thread and the rotary hook assembly rotates through a predetermined angle, said movable knife means catches the thread and cuts the thread in cooperation with said fixed knife means;

e) bobbin stopping drive means for driving said bobbin stopping means when the hook of the rotary hook assembly catches the needle thread and the rotary hook assembly rotates through a predetermined angle, such that said bobbin stopping means contacts a portion of the bobbin of the rotary hook assembly where the needle thread has already passed over.

2. The thread trimmer mechanism according to claim 1 wherein said first position is closely adjacent said point of connection of the thread to cloth being sewn whereby cut ends of thread extending from the cloth are short and do not require a separate trimming operation.

3. The thread trimmer mechanism according to claim 1, wherein said bobbin stopping means includes pressing means for applying frictional resistance to the bobbin in the rotary hook assembly.

4. The thread trimmer mechanism according to claim 3 wherein said bobbin pressing means includes an end portion contacting and applying the frictional resistance to the bobbin in the rotary hook assembly which is comprised of a leaf spring material.

5. The thread trimmer mechanism according to claim 1, wherein:

a) said fixed knife means has a cutting edge located at said first position; and, b) said movable knife means moves over said cutting edge of said fixed knife means when moving between said second position and said third position, said movable knife means includes a hook-shaped end which passes over said cutting edge of said fixed knife means to catch thread at said third position which is located beyond said first position from said second position.

6. The thread trimmer mechanism according to claim 5, wherein said hook-shaped end includes a slot extending along a length thereof between an opening on a side thereof for catching thread and guiding it into said slot and a cutting edge at an outer end of said slot facing said cutting edge of said fixed knife means whereby after catching thread in said slot and retracting from said third position towards said second position said movable knife means pulls the thread between said cutting edge of said fixed knife means and said cutting edge at said outer end of said slot.

7. The thread trimmer mechanism according to claim 1, further comprising first locking means for locking said movable knife means in said second position retracted from said first position during normal sewing operations of the sewing machine.

8. The thread trimmer mechanism according to claim 7, further comprising:

second locking means for preventing said bobbin stopping means from contacting the bobbin during normal sewing operations of the sewing machine.

9. The thread trimmer mechanism of claim 8, further comprising:

a) first bias means for applying a bias force to said movable knife means urging it towards said third position;

b) second bias means for applying a bias force to said bobbin stopping means urging it towards said operational position; and c) cam means for holding said movable knife means in said second position and said bobbin stopping means in said retracted position against said bias force of said first and second bias means during normal sewing operations of the sewing machine and for releasing said movable knife means and said bobbin pressing means to perform thread-cutting operations.

10. A sewing machine capable of cutting needle thread and bobbin thread in a bed thereof comprising:

a reciprocable needle having the needle thread;

a rotatable loop taker for catching and extending a loop of the needle thread in said bed;

a bobbin rotatably disposed in said loop taker for supplying the bobbin thread;

a thread cutting device provided in said bed for cutting the needle thread and the bobbin thread at a position between an upper surface of said bed and said loop taker;

restricting means movable between a separating position at which said restricting means separates from said bobbin and an abutting position at which said restricting means abuts on said bobbin for restricting spinning of said bobbin;

first moving means for moving said restricting means from said separating position to said abutting position before said cutting device cuts the needle thread and the bobbin thread and after said loop taker rotates a predetermined angle with the loop of the needle thread, so that said restricting means abuts on a portion of said bobbin where the loop of the needle thread has already passed over.

11. The sewing machine according to claim 10, wherein said first moving means moves said restricting means from said separating position to said abutting position after said loop taker rotates by 180° degrees with the loop of the bobbin thread, so that said restricting means abuts the portion of said bobbin after the loop of the needle thread has passed half of an end surface of said bobbin.

12. The sewing machine according to claim 10, wherein said restricting means includes an end portion abutting on said bobbin and applying frictional resistance to said bobbin.

13. The sewing machine according to claim 10, wherein said thread cutting device includes a fixed knife member fixed in said bed, a movable knife member capable of catching the needle thread and the bobbin thread, and second moving means for moving said movable knife member toward said fixed knife member after said movable knife member catches the needle thread and the bobbin thread.

14. The sewing machine according to claim 13, further comprising:

first prohibiting means for prohibiting said restricting means from moving while said sewing machine is executing normal sewing; and second prohibiting means for prohibiting said movable knife member from moving while said sewing machine is executing normal sewing.

* * * * *